United States Patent [19]

Silva

[11] Patent Number: 4,524,891

[45] Date of Patent: Jun. 25, 1985

[54] NEEDLE KEEPER DEVICE

[76] Inventor: Rosemary A. Silva, 4400 Turf, El Paso, Tex. 79936

[21] Appl. No.: 557,195

[22] Filed: Dec. 1, 1983

[51] Int. Cl.[3] ..... A41H 31/00

[52] U.S. Cl. ..... 223/109 R; 206/382

[58] Field of Search ..... 223/109 R, 108, 107, 223/106; 206/380, 382, 383

[56] References Cited

U.S. PATENT DOCUMENTS

| | | | |
|---|---|---|---|
| 417,922 | 12/1889 | King | 223/109 R |
| 2,573,311 | 10/1951 | Cupler | 206/382 X |
| 2,646,196 | 7/1953 | York | 223/106 |
| 3,603,492 | 9/1971 | Schantz | 223/109 R |
| 4,203,518 | 5/1980 | Current | 206/380 |

*Primary Examiner*—Werner H. Schroeder
*Assistant Examiner*—J. L. Kravitz

[57] ABSTRACT

This needle keeper is designed to receive and retain a multiple number of needles in safety. Primarily, it consists of a cardboard disc, which receives a portion of a felt disc within its openings, for the insertion of threaded needles, and a third disposable disc is included, which serves as a writing surface for identifying the colors of the threads of the respective needles retained by the device.

1 Claim, 4 Drawing Figures

NEEDLE KEEPER DEVICE

This invention relates to sewing articles, and more particularly, to a needle keeper device.

The principal object of this invention is to provide a needle keeper device, which will be unique and novel for being employed by those who engage in sewing.

Another object of this invention is to provide a needle keeper device, which will retain needles that are in threaded condition, in a uniform manner radially on the device, for safety.

A further object of this invention is to provide a needle keeper device, which will enable the user to select the desired needle and thread combination quickly and easily.

Other objects are to provide a needle keeper device, which is simple in design, inexpensive to manufacture, rugged in construction, easy to use, and efficient in operation.

These, and other objects, will be readily evident, upon a study of the following specification, and the accompanying drawing, wherein.

Figure 1:
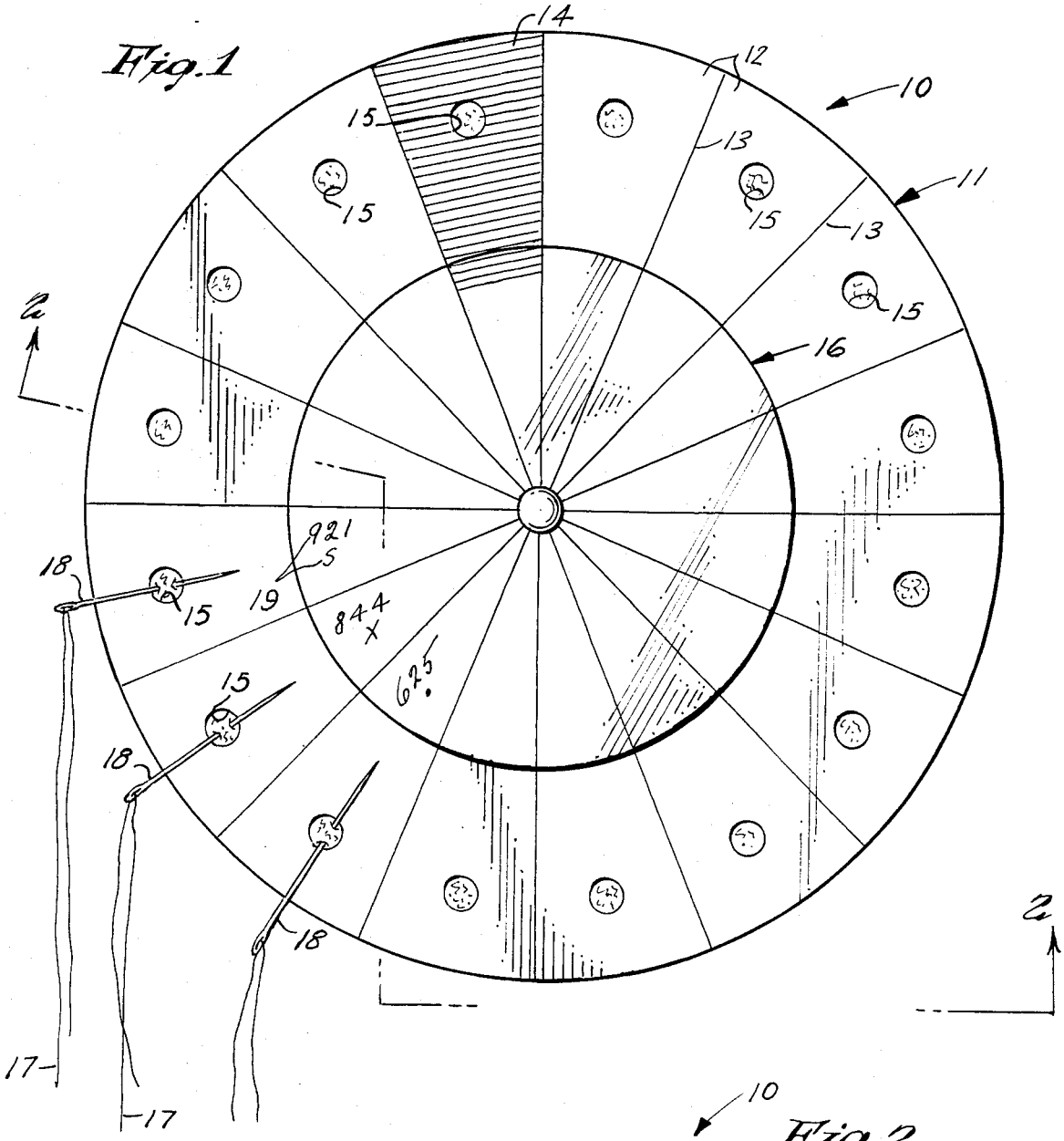
FIG. 1 is a top plan view of the present invention.
Figure 2:
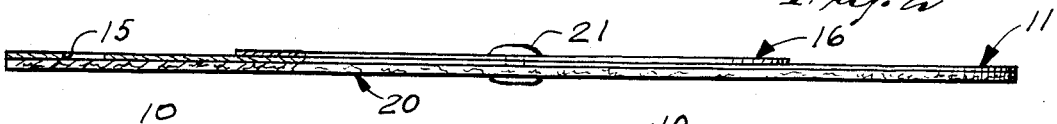
FIG. 2 is a side elevational view, shown partly in cross-section, as viewed along the line 2—2 of FIG. 1.
Figure 3:
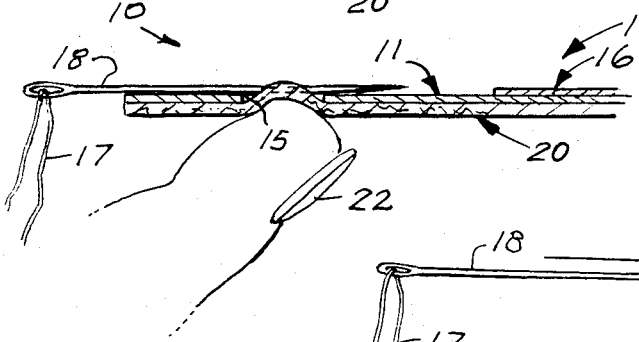
FIG. 3 is an enlarged fragmentary view of FIG. 2, illustrating a threaded needle being inserted thereon.

Accordingly, a device 10 is shown to include a circular cardboard disc 11, having a plurality of equally and radially spaced segments 12, which are defined by means of inscribed radial lines 13 upon the top face of disc 11. The single segment 14, disposed between a pair of the segments 12, is of any desired color, and serves to indicate the zero position of device 10. An opening 15 is also provided through disc 11, near its outer peripheral edge, for a purpose which hereinafter will be described, and a disposable paper disc 16 is centered on the face of disc 11, and is of smaller diameter, which is used for writing the number or sign for each color of thread 17 of the needles 18. The identification of the threads 17, for example, are indicated by the characters 19.

A circular felt disc 20 is of the same diameter as disc 11, and serves as a backing, and also provides for receiving and rendering the needles 18 stationary on device 10. The discs 11, 16, and 20 are fastened together at their centers by a suitable brad 21, and the use thereof is as follows:

In securing a needle 18 to device 10, the user places a finger 22 on the bottom of felt disc 20, in alignment with the opening 15 of the segment 12 desired. The user then applies pressure which urges the felt of that area into the opening 15, which causes the felt to extend from the face of disc 11, and, at this point, the user urges the needle 18 through the felt. Upon release of the user's finger 22 pressure, the inherent characteristic of the felt and opening 15 combination, causes the felt to tend to retain its flat condition, and thus, the needle 18 is retained therein, until it is desired to remove it.

Figure 4:
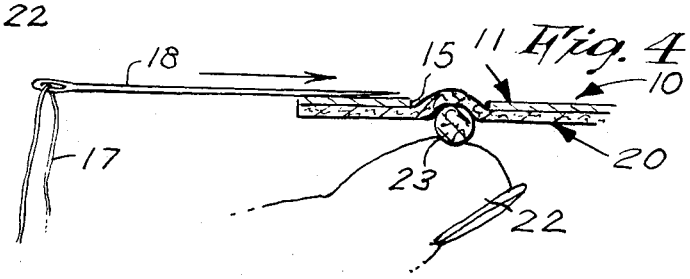
FIG. 4 is similar to FIG. 3, but shows a modified structure thereof.

Referring now to FIG. 4 of the drawing, the structure of device 10 is modified to include a circular ring of felt 23, which is also circular in cross-sectional configuration, for finger 22 pressure to be applied to it in using the device, and felt 23 is secured to disc 20.

In use, the user applies finger 22 pressure to the ring of felt 23, instead of directly to the bottom of felt disc 20, as was heretofore described, thus eliminating the former need of pressing the felt disc 20 as hard and deep into the opening 15, which will prevent the possible danger of the needle 18 injuring the user's finger when inserting same.

While various changes may be made in the detail construction, it is understood that such changes will be within the spirit and scope of the present invention, as is defined by the appended claims.

What I now claim is:

1. A needle keeper device, comprising, in combination, a relatively larger circular disc made of cardboard, and a relatively smaller circular, disposable paper disc, said discs being fastened concentrically together by a brad through the centers thereof, a plurality of equally and radially spaced segments defined upon said larger disc by means of inscribed radial lines upon the top face thereof, a single one of said segments being colored for defining a zero position of said larger disc, a circular opening through an exposed portion of each said segment, and a circular felt pad of the same diameter as said larger disc being fastened to the bottom side thereof and covering said openings; said openings being made along a circular row that is concentric with said larger disc, and a circular felt ring fastened concentrically to an underside of said larger disc, said felt ring extending across the center of each said opening, and each said opening being of a diameter whereby pressure of a person's finger against an underside of said felt ring causes only said felt pad to be pushed upwardly through said opening for receiving a needle slid upon said top face and across said opening; and an upper surface of said smaller disc being suitable for writing thereupon.

* * * * *